United States Patent [19]

Moffitt

[11] 4,025,023

[45] May 24, 1977

[54] BURSTER APPARATUS

[75] Inventor: John Stuart Moffitt, San Jose, Calif.

[73] Assignee: International Business Machines Corporation, Armonk, N.Y.

[22] Filed: Oct. 31, 1975

[21] Appl. No.: 627,713

[52] U.S. Cl. ..... 225/100; 225/5

[51] Int. Cl.[2] ..... B26F 3/02

[58] Field of Search ..... 225/2, 4, 5, 84, 94, 225/96, 100, 101, 106; 242/75.3, 147 A

[56] References Cited

UNITED STATES PATENTS

| | | | |
|---|---|---|---|
| 2,171,769 | 9/1939 | Stolar et al. | 225/97 |
| 2,246,228 | 6/1941 | Winter | 225/100 |
| 2,776,007 | 1/1957 | Dietz et al. | 225/100 |
| 2,796,223 | 6/1957 | Detweiler | 242/147 A X |
| 3,122,292 | 2/1964 | Ford et al. | 225/100 X |
| 3,481,520 | 12/1969 | Pickering | 225/100 X |

*Primary Examiner*—Frank T. Yost
*Attorney, Agent, or Firm*—Otto Schmid, Jr.

[57] ABSTRACT

A burster mechanism for separating continuous form webs into sheets along transverse pre-weakened lines comprising two sets of feeding means spaced along a curved web path so that one set of rolls is at an angle to the other. A curved guide member which extends between the two feeding means defines the outer curvature of the web path. The second feeding means is operable at a faster rate than the first feeding means and is actuated at a predetermined time to draw the web taut between the feeding means and separate the sheet from the web.

12 Claims, 9 Drawing Figures

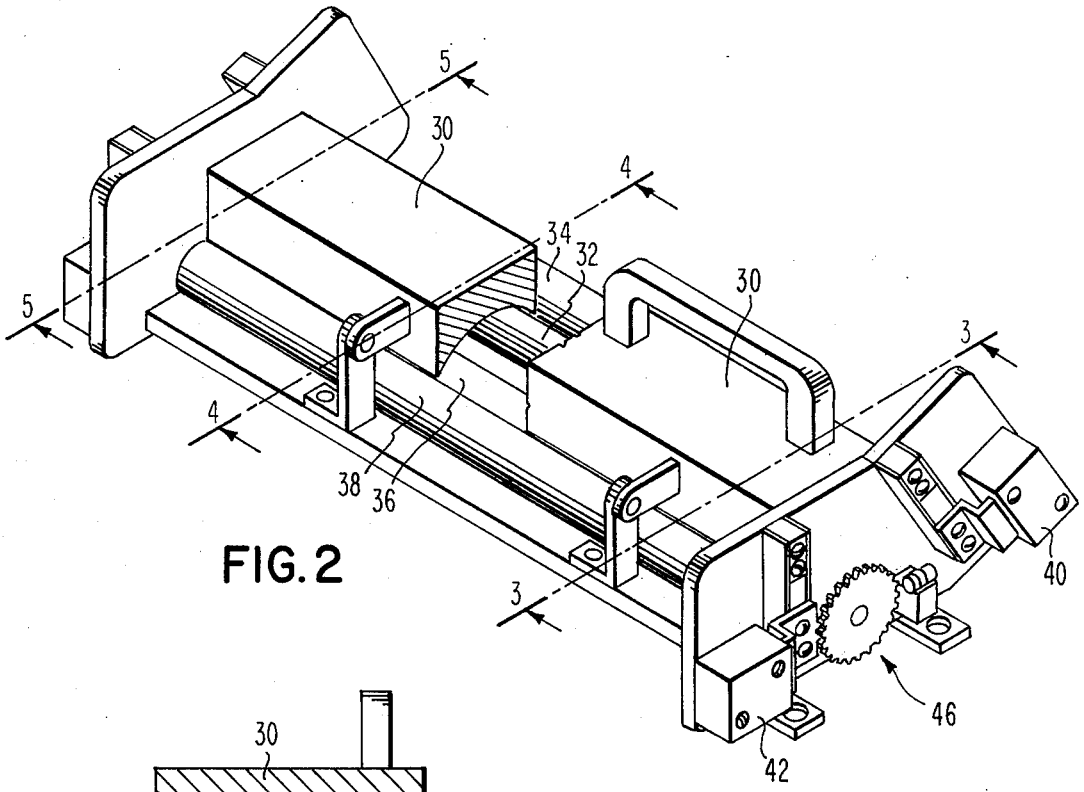
FIG. 2
FIG. 3
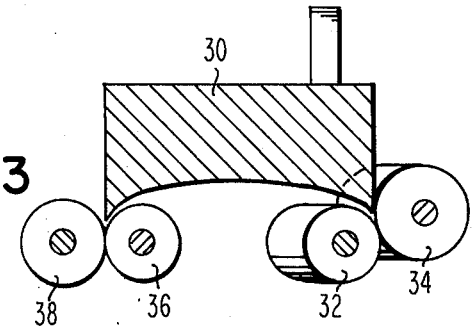
FIG. 4
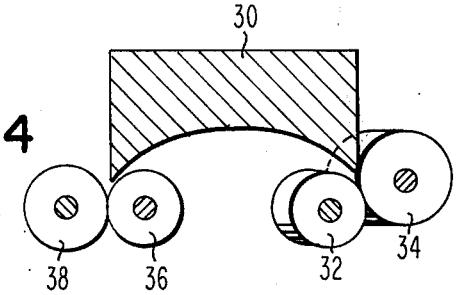
FIG. 5
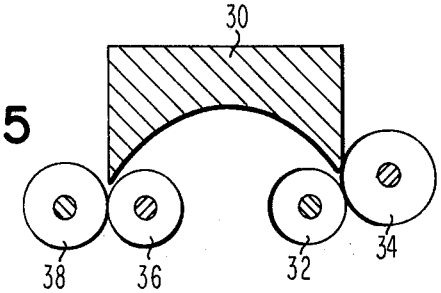
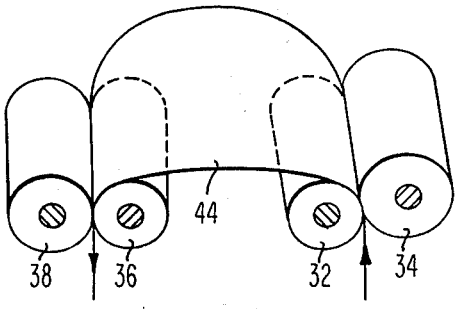
FIG. 6
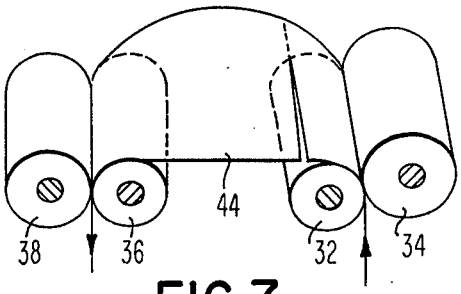
FIG. 7

BURSTER APPARATUS

BACKGROUND OF THE INVENTION

This invention relates to apparatus and a method for separating continuous forms into sheets and more particularly to apparatus which is operable to start the separation at one edge of the forms and progress across the sheet at a controlled rate.

A typical computer output printer operation sometimes has the requirement that the continuous forms (fan-fold) output be trimmed and separated into sheets and then further separated into sets of copies, data sets, or jobs for distribution to customers and/or operating segments of the organization. This work has traditionally been done off-line using a manually set up burster and trimmer and by manual separation of copies, data sets and jobs. As computer output printers have been developed which operate at higher and higher printing speeds, the postprinting processing of the printed output has become more of a problem in achieving the throughput the printer is capable of producing. For this reason, it would be desirable to perform these operations on-line in the printer. The biggest deterrent to the on-line performance of these operations is the burster since prior art bursters have some characteristics which make them unsuitable for a data processing environment such as excessive noise, vibration and the requirement for operator attendance. It is the purpose of this invention to provide a burster mechanism having sufficiently low noise and vibration characteristics so that it can be run on-line with a computer output printer with sufficient reliability so that operator attendance is not required.

SUMMARY OF THE INVENTION

Briefly, according to the invention, there is provided burster apparatus, comprising a first feeding means for feeding a continuous form web along a curved path at a predetermined speed, a second feeding means mounted at an angle to the first feeding means with a speed substantially faster than the predetermined speed, a curved guide member mounted between the feeding means to define the outer curvature of the curved path, and control means for selectively activating the second feeding means at a predetermined time in response to an electrical control signal to draw the web taut between the feeding means and separate the web along a pre-weakened line starting at one edge due to the angular disposition of the feeding means.

BRIEF DESCRIPTION OF THE DRAWINGS

FIG. 2 is an isometric view of the burster apparatus;

FIG. 3 is a partial section view along line 3—3 of FIG. 2;

FIG. 4 is a partial section view along lines 4—4 of FIG. 2;

FIG. 5 is a partial section view along lines 5—5 of FIG. 2;

FIG. 6 is a diagrammatic schematic view of the burster apparatus showing the web in position for a bursting operation;

FIG. 7 is a diagrammatic schematic view of the burster apparatus showing the web with the bursting operation partially completed;

DETAILED DESCRIPTION OF THE PREFERRED EMBODIMENT

Figure 1:
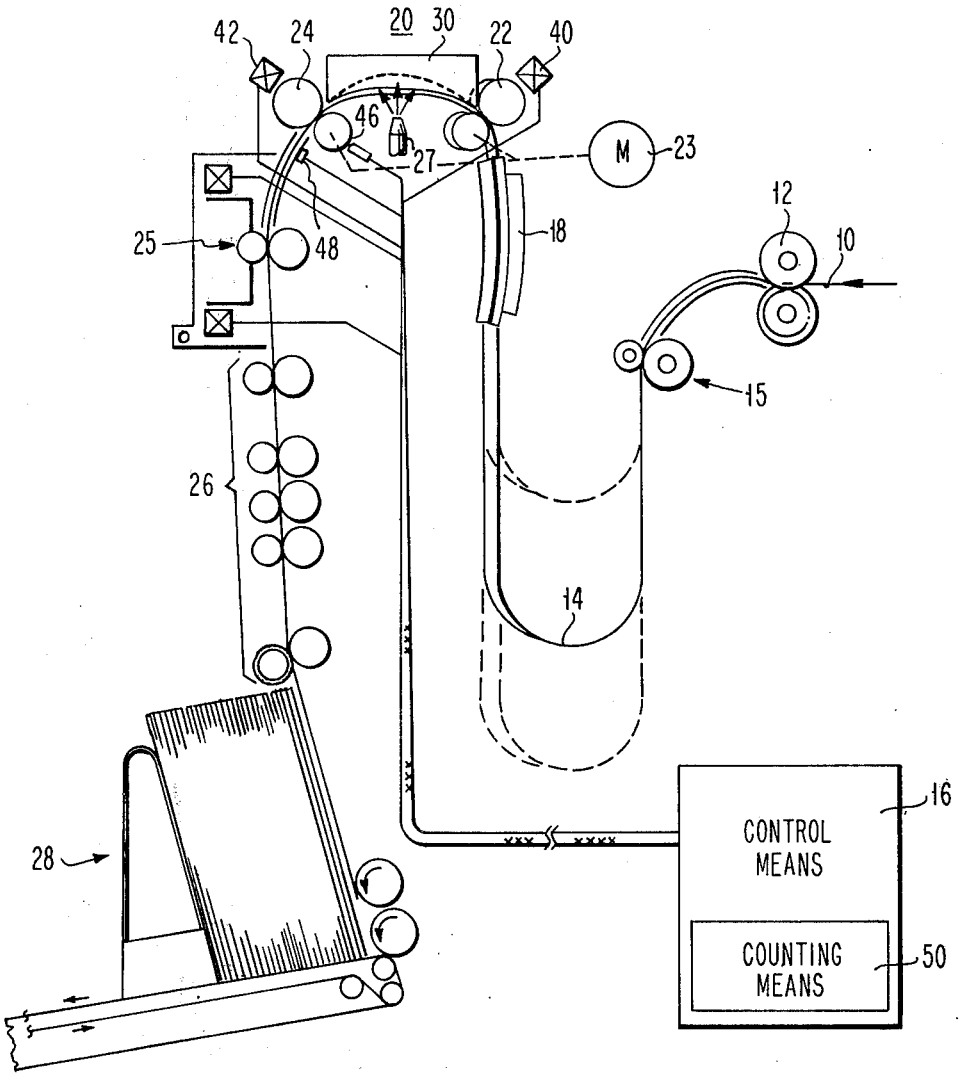
FIG. 1 is a schematic front view of a web processing system embodying the present invention.

The invention will be described as a part of a post-processing system for operation on-line with a computer output printer. However, it will be obvious to those skilled in the art that this burster apparatus has characteristics which will render it usable in a wide variety of applications.

The continuous form web 10 from the printer is fed through suitable guides to trimmer apparatus 12. The trimmer appatatus functions to trim by means of two co-acting rotary knives the carrier strip on each side of the web which carries the tractor holes which have been used to feed the web up to this point. The trimmed web is then guided into a buffer loop 14. The function of the buffer loop is to de-couple the post-processing apparatus from the printer since the post-processing apparatus runs at a faster rate. When a maximum loop has been established, the post-processing apparatus is run until some minimum loop results and it then stops until additional web is supplied by the printer. The process is repeated when the maximum loop is again reached. The loop is adjusted for a given length during thread-up so that control means 16 can use this information along with the known length of forms being printed to keep track of individual printed sheets in the web throughout the post-processing operation.

From the buffer loop the web proceeds through steering guides 18 to burster apparatus 20 which will be described in detail below. Briefly, however, the web is fed into burster apparatus 20 by means of first feeding means 22 which is driven at a speed slightly in excess of the nominal printer speed. Bursting is accomplished by second feeding means 24 which is selectively actuated for feeding the web at a speed substantially faster than the input speed so that the sheet is separated along the transverse pre-weakened line. The separated sheet proceeds to an offset station 25 where the sheet may selectively be given a lateral displacement while maintaining the same forward component of velocity. The sheet is then transported through sheet handling means 26 to a suitable sheet stacker 28.

The apparatus for handling the sheet after it is separated from the web is described in greater detail and claimed in copending application Ser. No. 627,740 filed Oct. 31, 1975 entitled "Sheet Handling Apparatus" by Harold P. Wicklund, now U.S. Pat. No. 3,994,437 issued Nov. 30, 1976.

Bursting apparatus 20 comprises first feeding means 22 spaced along a curved web path from second feeding means 24 at a small angle to the second means. The angle is chosen based on the spacing between feeding means 22, 24, the width of paper being used, the speed ratio between input feeding means 22 and burster feeding means 24 and other factors. In a specific embodiment designed to process paper up to 14 ⅞ inches wide and a minimum of 3 ½ inches long, the angle was chosen at about 1.8°. The angle is set so that the feeding means are closer together at the back as shown in FIGS. 6 and 7. A curved guide member 30 is positioned between the feeding means 22, 24 to define the outer boundary of the curved web path. Guide member 30 has a compound curve having some conical portions and some cylindrical portions blended together into a continuous curve as can be seen more clearly in FIGS. 3, 4 and 5. The force produced by input feeding means 22 in feeding the web into the burster forces the web to follow the curvature of guide member 30. If desired, air from nozzle means 27 may be used to assist in conforming the web to the shape of guide member 30. The curvature of guide member 30 guides the web squarely into the nip of feeding means 24 without tending to pull the web from the square engagement with feeding means 22. Guide means 30 is preferably produced by molding from a suitable material such as a polycarbonate material, for example. The molded material may be transparent so that visual access is provided to the curved web path for assistance in initial thread-up of the web or clearance of jams in the web path should they occur.

First feeding means 22 comprises a constantly running feedroll 32 and a cooperating pressure roll 34. Second feeding means 24 comprises a constantly running feed roll 36 and a cooperating pressure roll 38. Feed roll 36 of second feeding means 24 is driven at a speed substantially faster than feed roll 32. Feed rolls 32, 36 are driven by any suitable means such as by motor 23 through suitable belts or gears (shown dotted in the drawings). The ratio of these speeds is a design choice and the rates would normally be in the range of about 1.3 to 1.5. There is a trade-off between bursting speed and the post-burst speed at which the sheet transport is required to run. In a specific embodiment of the apparatus this ratio was 1.44. Pressure rolls 34 and 38 are selectively actuated by an electrical control signal from control means 16 to the respective operating magnets 40, 42. Magnet 40 is actuated on a PROCESS signal from control means 16 to activate first feeding means 22 and feed the web squarely through the nip of rolls 32, 34. A bend or "buckle" is formed as the web is forced to follow the curvature of guide member 30 and the curvature of guide member 30 is designed so that the web is also fed squarely into the nip of rolls 36, 38. A BURST signal is produced by control means 16 at the appropriate time for bursting the sheet size being processed. The sheet size being processed is indicated by the operator at the start of a printing job by a push button on the control panel, for example, and the control unit utilizes this information to generate the BURST signal at the appropriate time. The maximum stress concentration in the burster is at the top center of roll 32 so the BURST signal would normally be timed so that the burst operation begins with the perforation at this point although the burst will still be made if the timing is set so that the burst can be completed in a burster area between feeding means 22, 24.

An important part of the operation of my burster is the relation between steering guides 18 and burster apparatus 20. The web is fed into the burster through input rolls 32, 34. When a web is fed by rolls, the web tends to skew or progressively feed more and more to one side. My burster apparatus permits a relatively simple passive mechanical steering guide to be used instead of a servomechanism controlled steering which is much more expensive and usually trouble prone. The The guide operates on the principle that a frictional force generated on one edge of the paper will cause it to move in the opposite direction. However, for this type of steering to be operative, the gripping force exerted by feedrolls 32, 34 on the web must be sufficiently low that the web can slip within the rolls. On the other hand, prior art bursters have required a gripping force so that a non-slip engagement with the web is necessary to burst the web into sheets. My burster apparatus permits steering of the web due to the position of feeding means 22, 24 along radial lines for the curved web path when in a feeding mode. However, when bursting occurs, the web is drawn taut between feeding means 22, 24. This position of the web results in more of a wrap on feedrolls 32, 36 and consequently a greater frictional engagement so that the web can be reliably burst into sheets.

When a pre-weakened line of web 10 reaches a predetermined position relative to the nip of input rolls 32, 34, burster rolls 36, 38 are brought together so that they grip the web firmly. This predetermined position is a design choice based on the speed ratios of the feeding means, the amount of web in the buckle, etc., and for the specific embodiment described herein, the preferred position is just past the nip of rolls 32, 34. Since burster rolls 36, 38 are turning at a faster speed than input rolls 32, 34, they begin pulling out slack between themselves and input rolls 32, 34. Because there is a slack differential, one edge 44 becomes taut (see FIG. 7) while the remainder of the sheet is still slack. The force generated by the faster speed of burster rolls 36, 38 is applied along edge 44 until separation starts along the preweakened perforation. As the burster rolls continue to take out slack, the separation progresses across the web. After bursting is completed, rolls 36, 38 are opened again to their original position and a "buckle" is again formed in the next sheet, and the cycle is ready to repeat.

The distance along the curved web path between feeding means 22 and feeding means 24 is chosen to be approximately the length of the shortest sheet to be processed, for example, 3.6 inches for a 3 ½ inch sheet. Thus, when processing 3 ½ inch paper, the burster rolls 34, 36 remain engaged and separation of the web into 3 ½ inch sheets is accomplished in a continuous operation.

However, for sheets longer than the minimum length, a control signal is provided to control bursting at the appropriate time for the sheet length being processed. The control signal is provided by control means 16. Control means 16 may comprise hard-wired control circuits designed to produce the desired control functions. Alternatively, control means 16 may comprise signals generated from programmed instructions from the data processing system of which the printer is a part. The means for generating the burster control signal comprises sheet position sensor means 48 and pulse producing means 46 which functions to produce a series of electrical control pulses, the frequency of which is proportional to the speed of the web through feeding means 24. In the embodiment shown, pulse producing means 46 comprises an emitter which is coupled to the same shaft as the feed roll 36. The emitter comprises a circular member having a plurality of spaced teeth members on its peripheral surface. When one of the teeth members is aligned with a magnetic pickup member, a low reluctance path is established and an electrical pulse is produced in the pickup circuit. In the embodiment shown, sheet position sensor means 48 comprises a photodetector mounted adjacent the web path near feeding means 24 and a light source mounted adjacent the detector. When the leading edge of the web comes to the light source and detector, reflection of light from the paper to the photodetector causes a signal to be generated which signifies to the control means that the web has arrived at a known position. The light and photocell could also be mounted so that the web comes between them to generate the signal. The edge detector signal is utilized to start a count of the pulses from emitter 46. When the count reaches the number corresponding to only the minimum length of sheet remain-ing between feeding means 22, 24, a signal is generated to energize magnet 42 to engage pressure roll 38 with continuously running roll 36, thereby initiating bursting.

In accordance with a specific embodiment of the invention, a specific example control of the burster will be described for sheet lengths of 3.5, 5.5, 7, 8.5 and 11 inches. Control of the burster is different for the minimum length sheet (3.5 inches in the specific example) and other sheet lengths. Operation is basically continuous for the minimum length sheets and for other sheet lengths the bursting is timed for the sheet length being processed. Control of the timing for the burster operation is accomplished by counting means 50 which is a count-down counter in the specific example. When processing 3.5 inch sheets, the operation is continuous and starts in response to a PROCESS signal from control means 16. A count of 45 is set into counting means 50 and magnet 40 is energized to close pressure roll 34. The web is present between rolls 32 and 34 from the initial thread-up operation or from a previous burst operation so closure of the rolls starts the feed of web 10 through the burster apparatus. A signal BURST LOW current is also generated at this time and sent to magnet 42 to close burster pressure roll 38. The full current is not applied at this time to reduce noise and vibration as the magnet is energized. A count 42 a signal BURST HIGH current is applied to magnet 42 to develop the full force between the burster rolls. Feeding continues until one of two events occurs.

The first possiblity is that the counter which is decremented by pulses from emitter 46 reaches zero before the leading edge of the web reaches sensor means 48 and in this case an error is indicated and feeding is stopped. The count of 45 would normally provide sufficient time for the leading edge of the web to be fed to sensor 48, so the failure to arrive within that time indicates either a jam along the web path, that the control unit 16 has lost synchronism with the sheets forming web 10 or some other malfunction.

Figure 8:
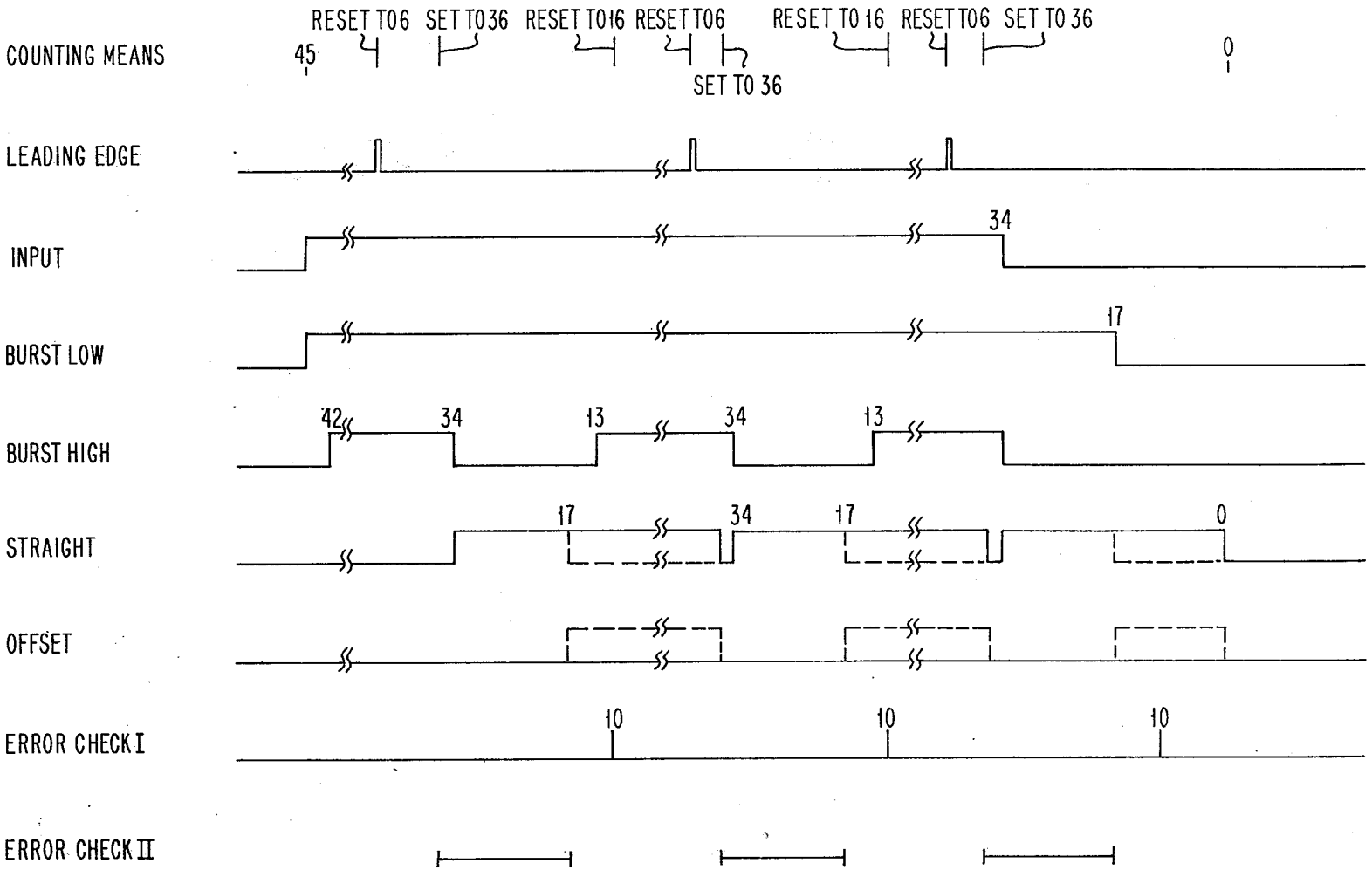
FIG. 8 is a timing diagram showing the relative times at which various components are actuated to control the bursting operation for minimum length sheets.

The second possibility is that the leading edge of the web reaches sensor 48 before the counter reaches zero. A LEADING EDGE signal is generated as a result and this signal is sent to the control means. Some flutter can occur as the leading edge of the web moves along the path so a count of six elapses after the leading edge is first detected before further control action is taken to remove the possibility of spurious results due to leading edge flutter. After six counts have elapsed, the offset station straight ahead rolls are reset open and a count of 36 is placed in counting means 50. The burster operates as previously described and at count 34 the BURST HIGH current signal goes down and the straight ahead rolls are energized. An offset decision is made at count 17 and this is shown dotted since this is a selective function. If detector 48 sensed a second leading edge during the bursting operation, this is an error indication since the sheet has been separated at the wrong place or the control unit has lost synchronism with the web movement. This check is shown as error check II in FIG. 8. An error check is made at count 10 to determine whether sensor 48 is uncovered since at this time the trailing edge of the just-burst sheet should have cleared the sensor. If not, this means that the sheet was not burst or that the control unit has lost synchronism with the web movement. Under normal operation the sensor is uncovered at the error check time and a count of 16 is set into counter 50. This count provides sufficient time for the leading edge of the next sheet to reach sensor 48 before the counter reaches zero under normal operating conditions. This sheet and all subsequent sheets are processed as shown in FIG. 8 in a continuous fashion until the control unit decision is made that the current sheet is the last sheet to be processed. As can be seen by reference to FIG. 8, for the last sheet the input rolls are opened at count 34 and the burster rolls are opened at count 17. This leaves the end of web 10 between input rolls 32, 34 in position for further operation.

Figure 9:
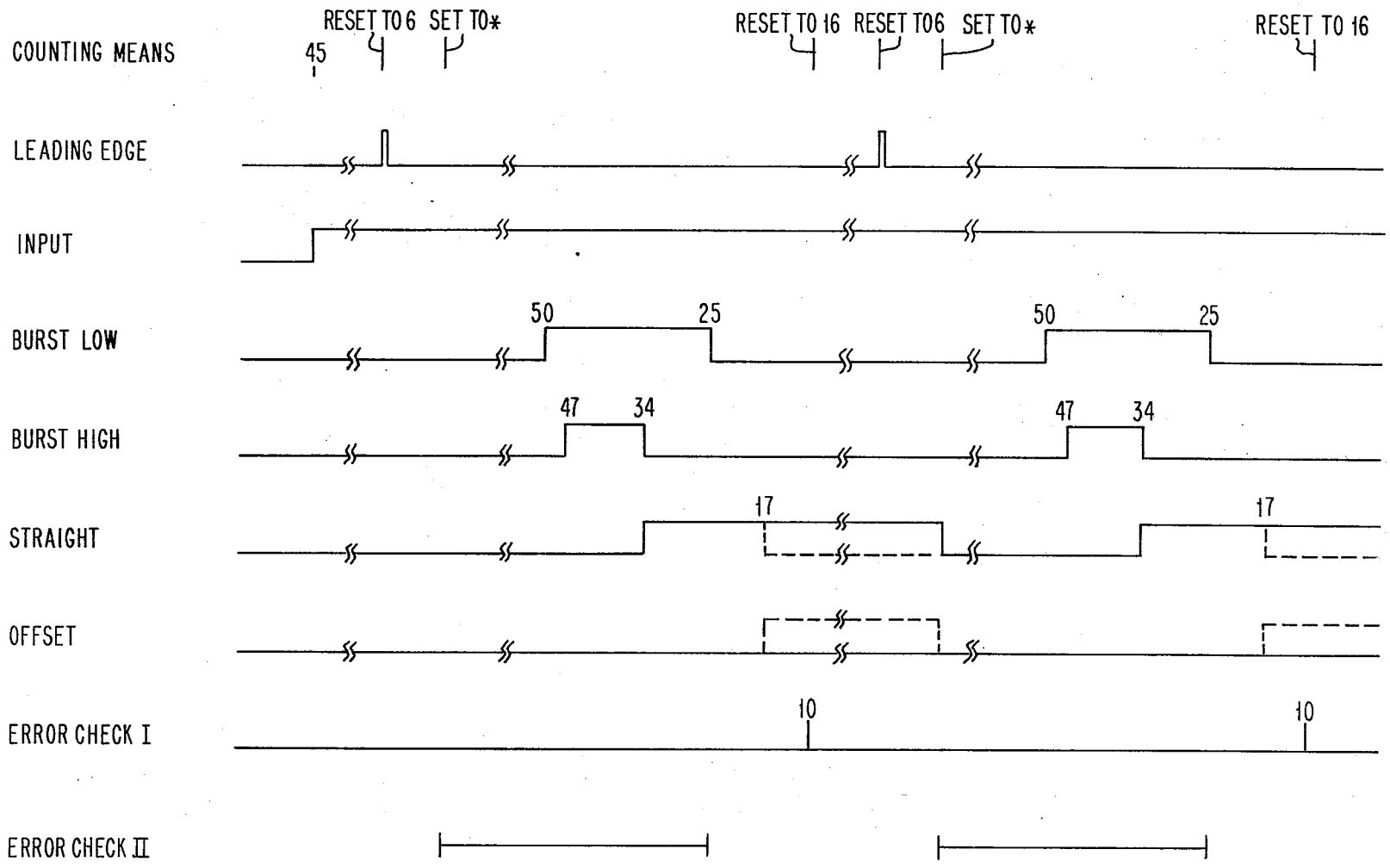
FIG. 9 is a timing diagram showing the relative times at which various components are actuated to control the bursting operation for other length sheets.

Control of the burster for sheet lengths of 5.5, 7, 8.5 and 11 inches is shown in FIG. 9. In response to a PROCESS signal from control means 16, a count of 45 is set into counting means 50 and magnet 40 is energized to close pressure roll 34. The web is present with approximately an inch of the web extending beyond rolls 32 and 34 from the initial thread-up operation or from a previous burst operation so closure of the rolls starts the feed of web 10 through the burster apparatus. Under normal operation, the leading edge of the web reaches sensor 48 before the counter reaches zero. A LEADING EDGE signal is generated as a result and this signal is sent to the control means. Some flutter can occur as the leading edge of the web moves along the path so a count of six elapses after the leading edge is first detected before further control action is taken to remove the possibility of spurious results due to leading edge flutter. After six counts have elapsed, the offset station straight ahead rolls 26 are reset open and a count is placed in counting means 50 based on the length of sheet then being processed as follows:

| Sheet length | Count |
|---|---|
| 5.5 | 51 |
| 7 | 64 |
| 8.5 | 78 |
| 11 | 102 |

As the web is fed, counting means 50 is decremented until a count of 50 is reached. At count 50 a signal BURST LOW current is produced and sent to magnet 42 to close burster pressure roll 38. The full current is not applied at this time to reduce noise and vibration as the magnet is energized. At count 47 the signal BURST HIGH current is applied to magnet 42 to develop the full force between the burster rolls. The burster operates as previously described and at count 34 the BURST HIGH current signal goes down and the outfeed rolls remain energized at reduced pressure. At count 25 the BURST LOW current signal goes down and the outfeed rolls are released. An error check is made at count 10 to determine whether sensor 48 is uncovered and assuming normal operation the trailing edge of the just-burst sheet should have cleared the sensor by this time.

A count of 16 is set in counter 50 at this time and operation continues in this manner until a control unit last sheet decision is made. In response to this signal, the input rolls are opened at count 34. The burst rolls are opened at count 25, and the operation is terminated at count zero at which time the offset station rolls are opened.

It is desired to burst all standard sizes and weights of paper that can be processed by the associated printer without any mechanical adjustment to the burster mechanism. An added factor of reliability is provided for some combinations of paper weights and sizes by the provision of an additional force on the web which forces the web to conform to the contour of guide means 30. In the embodiment shown in the drawings, this additional force is generated by an air stream directed from the inner radius of the curved web path toward guide member 30. The air stream is produced by an elongated opening 27 which extends across the width of the burster. A low level flow of air such as 40 CFM is provided to insure that the web end sheet follows the contour of guide 30. The flow of air also cleans out paper dust from the burster and this dust laden air is exhausted from the burster apparatus.

While the invention has been particularly shown and described with reference to a preferred embodiment thereof, it will be understood by those skilled in the art that various changes in the form and details may be made therein without departing from the spirit and scope of the invention.

I claim:

1. Apparatus for bursting into sheets a continuous form web as it is fed along a curved path comprising:

first feeding means for feeding a continuous form web having pre-weakened transverse lines along a curved path at a predetermined speed;

second feeding means mounted along said path at an angle to said first feeding means for feeding said continuous form web at a speed substantially faster than said first predetermined speed;

a curved guide member defining the outer curvature of said curved path, said guide member extending between said first and said second feeding means and having a continuous curved surface in which the linear dimension along one longitudinal edge of the surface is the same as the linear dimension along the opposite edge so that the curvature of the guide member directs said web squarely into said second feeding means;

means for selectively activating said second feeding means in response to an electrical control signal; and means for producing an electrical control signal at a predetermined time and applying the signal to said means activating said second feeding means to separate said web into sheets at said pre-weakened transverse lines due to the angular disposition of said feeding means the defined curved path and the faster speed of said second feeding means.

2. The apparatus of claim 1 additionally comprising:

means for producing a force toward said curved guide member to force said web to conform to the curvature of said guide member.

3. The apparatus of claim 2 wherein said means for producing a force comprises a gas stream directed toward said guide member.

4. The apparatus of claim 1 wherein said means for producing an electrical control signal comprises:

means for producing a series of electrical pulses in synchronism with the movement of said web through the burster apparatus; and means for counting a predetermined number of said pulses said predetermined number based on the size sheet being processed

5. The apparatus of claim 4 additionally comprising:

means for detecting when the web has reached a predetermined position and for generating a signal when the web reaches the predetermined position, and means for energizing said counting means in response to said web position detecting signal.

6. The apparatus of claim 1 wherein said second feeding means comprises a drive roll and a pressure roll selectively movable to nip-forming engagement with said drive roll to feed the web.

7. The apparatus according to claim 6 wherein said means for selectively activating said second feeding means comprises an electromagnet to close the pressure roll when energized.

8. Apparatus for bursting into sheets a continuous form web having pre-weakened transverse lines as it is fed along a web path comprising a set of input rolls, a curved guide member and a set of burster rolls, said appartus comprising:

a set of input rolls comprising an input drive roll constantly running at a first speed and a pressure roll mounted for selective movement to a nip-forming engagement with the drive roll;

a set of burster rolls comprising a burster drive roll constantly running at a speed substantially faster than said first speed and a pressure roll mounted for selective movement to a nip-forming engagement with a burster roll, said rolls being mounted so that the center-to-center distance from the input rolls to the burster rolls is greater on one end than at the other end;

a curved guide member mounted between said input rolls and said burster rolls to define the outer curvature of the web path, said guide member extending between said input rolls and said burster rolls and having a continuous curved surface in which the linear dimension along one longitudinal edge of the surface is the same as the linear dimension along the opposite edge so that the curvature of said guide member directs the web squarely into said set of burster rolls;

means for selectively moving said burster pressure roll to the nip-forming position;

means for generating an electrical control signal at a predetermined time; and means for activating said means for moving with said control signal to control bursting of the web into sheets at the pre-weakened transverse lines.

9. The apparatus of claim 8 additionally comprising:

means for producing a force toward said curved guide member to force said web to conform to the curvature of said guide member.

10. The apparatus of claim 9 wherein said means for producing a force comprises a gas stream directed toward said guide member.

11. The apparatus of claim 8 wherein said means for producing an electrical control signal comprises:

means for producing a series of electrical pulses in synchronism with the movement of said web through the burster apparatus; and means for counting a predetermined number of said pulses, said predetermined number based on the size sheet being processed.

12. The apparatus of claim 11 additionally comprising:

means for detecting when the web has reached a predetermined position and for generating a signal when the web reaches the predetermined position, and means for energizing said counting means in response to said web position detecting signal.

* * * * *